US010584594B2

(12) United States Patent
Neeli et al.

(10) Patent No.: US 10,584,594 B2
(45) Date of Patent: Mar. 10, 2020

(54) TURBINE DISCS AND METHODS OF FABRICATING THE SAME

(71) Applicant: General Electric Company, Schenectady, NY (US)

(72) Inventors: Sudhakar Neeli, Karnataka (IN); Sacheverel Quentin Eldrid, Saratoga Springs, NY (US); Robert Cormack Young, Mazowieckie (PL); Mariusz Robert Pulanecki, Mazowieckie (PL)

(73) Assignee: General Electric Company, Schenectady, NY (US)

( * ) Notice: Subject to any disclaimer, the term of this patent is extended or adjusted under 35 U.S.C. 154(b) by 881 days.

(21) Appl. No.: 15/179,594

(22) Filed: Jun. 10, 2016

(65) Prior Publication Data

US 2017/0159453 A1 Jun. 8, 2017

(30) Foreign Application Priority Data

Dec. 3, 2015 (PL) ..... P-415045

(51) Int. Cl.
*F01D 5/08* (2006.01)
*F01D 5/18* (2006.01)
*F01D 5/06* (2006.01)

(52) U.S. Cl.
CPC ..... *F01D 5/187* (2013.01); *F01D 5/066* (2013.01); *F01D 5/08* (2013.01); *F01D 5/087* (2013.01); *F05D 2220/32* (2013.01); *F05D 2230/00* (2013.01); *F05D 2250/71* (2013.01); *F05D 2260/202* (2013.01)

(58) Field of Classification Search
None
See application file for complete search history.

(56) References Cited

U.S. PATENT DOCUMENTS 4,203,705 A * 5/1980 Wesbecher ..... F01D 5/08 416/244 A
5,593,274 A * 1/1997 Carreno ..... F01D 5/081 285/300
5,997,244 A 12/1999 Gebre-Giorgis et al.
6,210,116 B1 4/2001 Kuczaj et al.
(Continued)

FOREIGN PATENT DOCUMENTS

CN 103867235 A 6/2014
DE 3436340 A1 4/1986
(Continued)

OTHER PUBLICATIONS http://www.ccj-online.com/know-your-7ea-turbine-a-backgrounder-for-newcomers/, Nov. 30, 2015, 2 pages.
http://freeliff.com/radial-inflow-turbines/, Nov. 30, 2015, 8 pages.
https://en.wikipedia.org/wiki/Centrifugal_compressor, Nov. 30, 2015, 22 pages.
(Continued)

*Primary Examiner* — Kayla Mccaffrey
(74) *Attorney, Agent, or Firm* — Armstrong Teasdale LLP

(57) ABSTRACT

A turbine disc having a radius and a circumference is provided. The turbine disc includes a central aperture and a plurality of cooling channels circumferentially spaced about the central aperture such that the cooling channels are in flow communication with the central aperture. Each of the cooling channels has a radially inner end, a radially outer end, and a lengthwise axis that is curved between the radially inner end and the radially outer end.

17 Claims, 7 Drawing Sheets

(56) References Cited

U.S. PATENT DOCUMENTS

| | | | | |
|---|---|---|---|---|
| 6,382,903 | B1 | 5/2002 | Caruso et al. | |
| 6,398,487 | B1 | 6/2002 | Wallace et al. | |
| 6,537,030 | B1 | 3/2003 | Garrison | |
| 7,210,226 | B2 | 5/2007 | Makinson et al. | |
| 7,708,519 | B2 | 5/2010 | Mignano | |
| 8,061,031 | B2 | 11/2011 | Ranz et al. | |
| 8,074,647 | B2 | 12/2011 | Truitt et al. | |
| 8,348,599 | B2 | 1/2013 | Chiu et al. | |
| 8,556,584 | B2 | 10/2013 | Mallaiah et al. | |
| 2001/0025476 | A1 | 10/2001 | Eldrid et al. | |
| 2009/0047133 | A1 | 2/2009 | Nishino | |
| 2011/0236190 | A1 | 9/2011 | Chiu et al. | |
| 2012/0003091 | A1* | 1/2012 | Segovia | F01D 5/082 416/95 |
| 2013/0343868 | A1 | 12/2013 | Jha et al. | |
| 2017/0159441 | A1 | 6/2017 | Neeli et al. | |

FOREIGN PATENT DOCUMENTS

| | | | |
|---|---|---|---|
| EP | 2369132 | A2 | 9/2011 |
| FR | 2406121 | A1 | 5/1979 |
| GB | 2295861 | A | 6/1996 |
| IT | 1212263 | B | 11/1989 |
| JP | 63253125 | A | 10/1988 |

OTHER PUBLICATIONS

Poland Patent Office Search Report for Patent Application No. P-415045, 1 page.

Extended European Search Report and Opinion issued in connection with corresponding EP Application No. 16200008.7 dated Apr. 6, 2017.

Summary report of Polish Office Action issued in connection with corresponding PL Application No. P-415045 on Oct. 26, 2018; 2 pp. Full English translation not available.

* cited by examiner

TURBINE DISCS AND METHODS OF FABRICATING THE SAME

CROSS-REFERENCE TO RELATED APPLICATIONS

This application claims the benefit of Polish Patent Application No. P-415045 filed on Dec. 3, 2015, which is incorporated by reference herein in its entirety.

BACKGROUND

The field of this disclosure relates generally to gas turbine assemblies and, more particularly, to turbine discs and methods of fabricating the same.

Many known gas turbine assemblies include a compressor, a combustor, and a turbine. Gases (e.g., air) flow into the compressor and are compressed. The compressed gas flow is then discharged into the combustor, mixed with fuel, and ignited to generate combustion gases. The combustion gas flow is channeled from the combustor through the turbine.

At least some known turbines include a plurality of rotor blades that are driven by the combustion gas flow, such that the rotor blades are subjected to higher-temperature operating conditions. It is common to cool the rotor blades by channeling cooling gases through the rotor blades and then injecting the cooling gas flow into the combustion gas flow. However, it can be difficult to inject the cooling gas flow into the combustion gas flow if the cooling gas flow is not adequately pressurized.

BRIEF DESCRIPTION

In one aspect, a turbine disc having a radius and a circumference is provided. The turbine disc includes a central aperture and a plurality of cooling channels circumferentially spaced about the central aperture such that the cooling channels are in flow communication with the central aperture. Each of the cooling channels has a radially inner end, a radially outer end, and a lengthwise axis that is curved between the radially inner end and the radially outer end.

In another aspect, a method of fabricating a turbine disc having a radius and a circumference is provided. The method includes forming a central aperture in a turbine disc and forming a plurality of cooling channels in the turbine disc such that the cooling channels are circumferentially spaced about the central aperture in flow communication with the central aperture. Each of the cooling channels has a radially inner end, a radially outer end, and a lengthwise axis that is curved between the radially inner end and the radially outer end.

In another aspect, a gas turbine assembly is provided. The gas turbine assembly includes a rotor disc and a spacer disc coupled to the rotor disc. The spacer disc has a radius and a circumference, and the spacer disc includes a central aperture and a plurality of cooling channels circumferentially spaced about the central aperture such that the cooling channels are in flow communication with the central aperture. Each of the cooling channels has a radially inner end, a radially outer end, and a lengthwise axis that is curved between the radially inner end and the radially outer end.

DETAILED DESCRIPTION

The following detailed description illustrates turbine discs and methods of fabricating the same by way of example and not by way of limitation. The description should enable one of ordinary skill in the art to make and use the turbine discs, and the description describes several embodiments of the turbine discs, including what is presently believed to be the best modes of making and using the turbine discs. Exemplary turbine discs are described herein as being coupled within a gas turbine assembly. However, it is contemplated that the turbine discs have general application to a broad range of systems in a variety of fields other than gas turbine assemblies.

Figure 1:
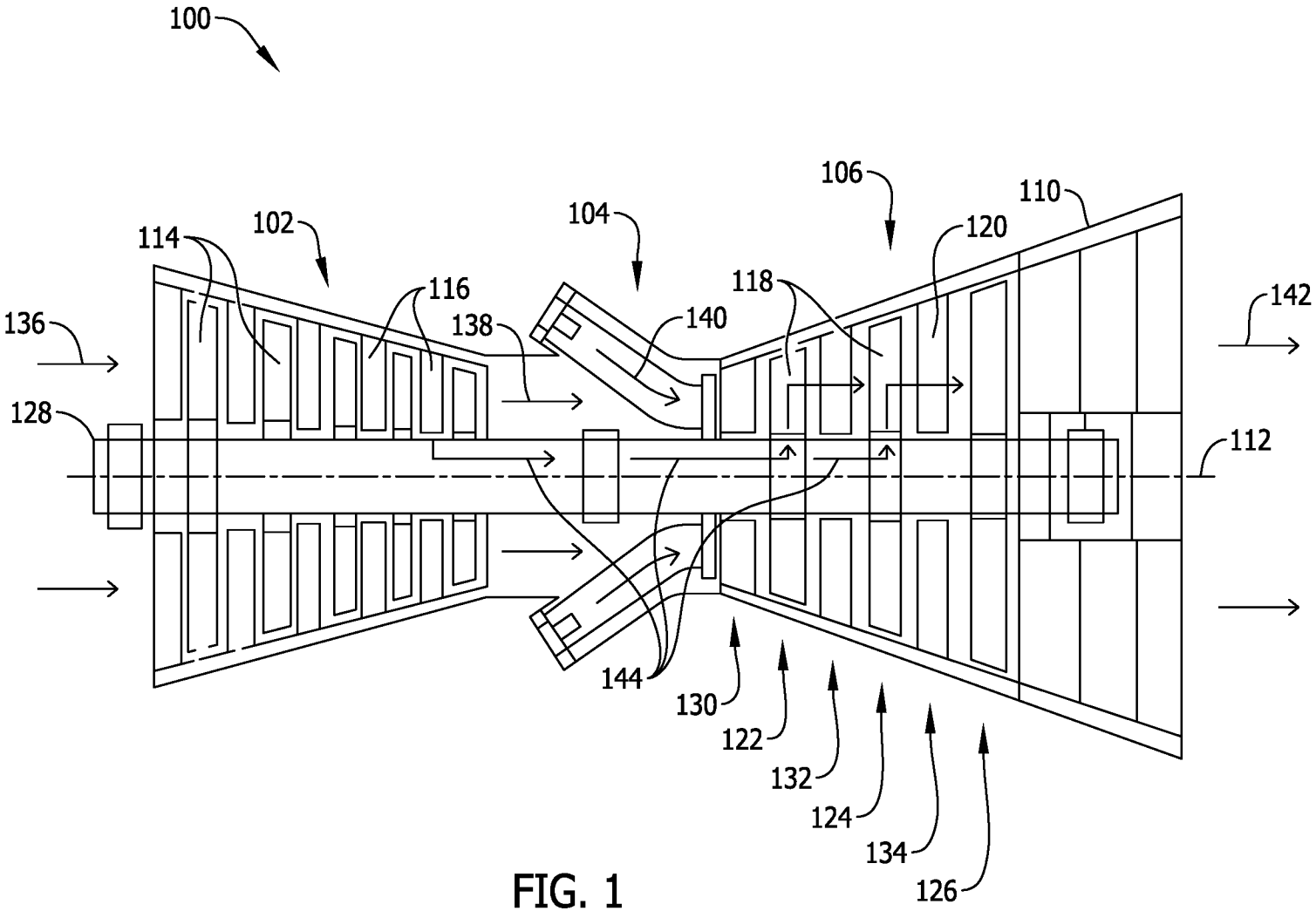
FIG. 1 is a schematic illustration of an exemplary gas turbine assembly.

FIG. 1 illustrates an exemplary gas turbine assembly 100. In the exemplary embodiment, gas turbine assembly 100 has a compressor 102, a combustor 104, and a turbine 106 coupled in flow communication with one another within a casing 110 and spaced along a centerline axis 112. Compressor 102 includes a plurality of rotor blades 114 and a plurality of stator vanes 116, and turbine 106 likewise includes a plurality of rotor blades 118 and a plurality of stator vanes 120. Notably, turbine rotor blades 118 (or buckets) are grouped in a plurality of annular, axially-spaced stages (e.g., a first rotor stage 122, a second rotor stage 124, and a third rotor stage 126) that are rotatable on an axially-aligned rotor shaft 128 that is rotatably coupled to rotor blades 114 of compressor 102. Similarly, stator vanes 120 (or nozzles) are grouped in a plurality of annular, axially-spaced stages (e.g., a first stator stage 130, a second stator stage 132, and a third stator stage 134) that are axially-interspaced with rotor stages 122, 124, and 126. As such, first rotor stage 122 is spaced axially between first and second stator stages 130 and 132, second rotor stage 124 is spaced axially between second and third stator stages 132 and 134, and third rotor stage 126 is spaced downstream from third stator stage 134. Notably, rotor shaft 128 is made up of a plurality of axially coupled shafts and discs in the exemplary embodiment, but rotor shaft 128 may be a single integral part in other embodiments. Moreover, while turbine 106 is described herein as having three rotor stages and three stator stages, it is contemplated that turbine 106 (and/or compressor 102) may have any suitable quantity of rotor stages and stator stages that facilitates enabling gas turbine assembly 100 to function as described herein.

In operation, a working gas flow 136 (e.g., ambient air) enters compressor 102 and is compressed and channeled into combustor 104. The resulting compressed gas flow 138 is mixed with fuel and ignited in combustor 104 to generate combustion gas flow 140 that is channeled into turbine 106. In an axially-sequential manner, combustion gas flow 140 is channeled through first stator stage 130, first rotor stage 122, second stator stage 132, second rotor stage 124, third stator stage 134, and third rotor stage 126. Combustion gas flow 140 is then discharged from turbine 106 as an exhaust gas flow 142.

As combustion gas flow 140 is channeled through turbine 106, combustion gas flow 140 interacts with rotor blades 118 to drive rotor shaft 128 which, in turn, drives rotor blades 114 of compressor 102. Thus, rotor blades 118 are subjected to higher-temperature operating conditions, and it is desirable to cool rotor blades 118 during operation of gas turbine assembly 100. To facilitate cooling rotor blades 118, a portion of compressed gas flow 138 (i.e., a cooling gas flow 144) is channeled into rotor blades 118 via rotor shaft 128 and is subsequently injected into combustion gas flow 140 in turbine 106, thereby enabling cooling gas flow 144 to bypass combustor 104.

Figure 2:
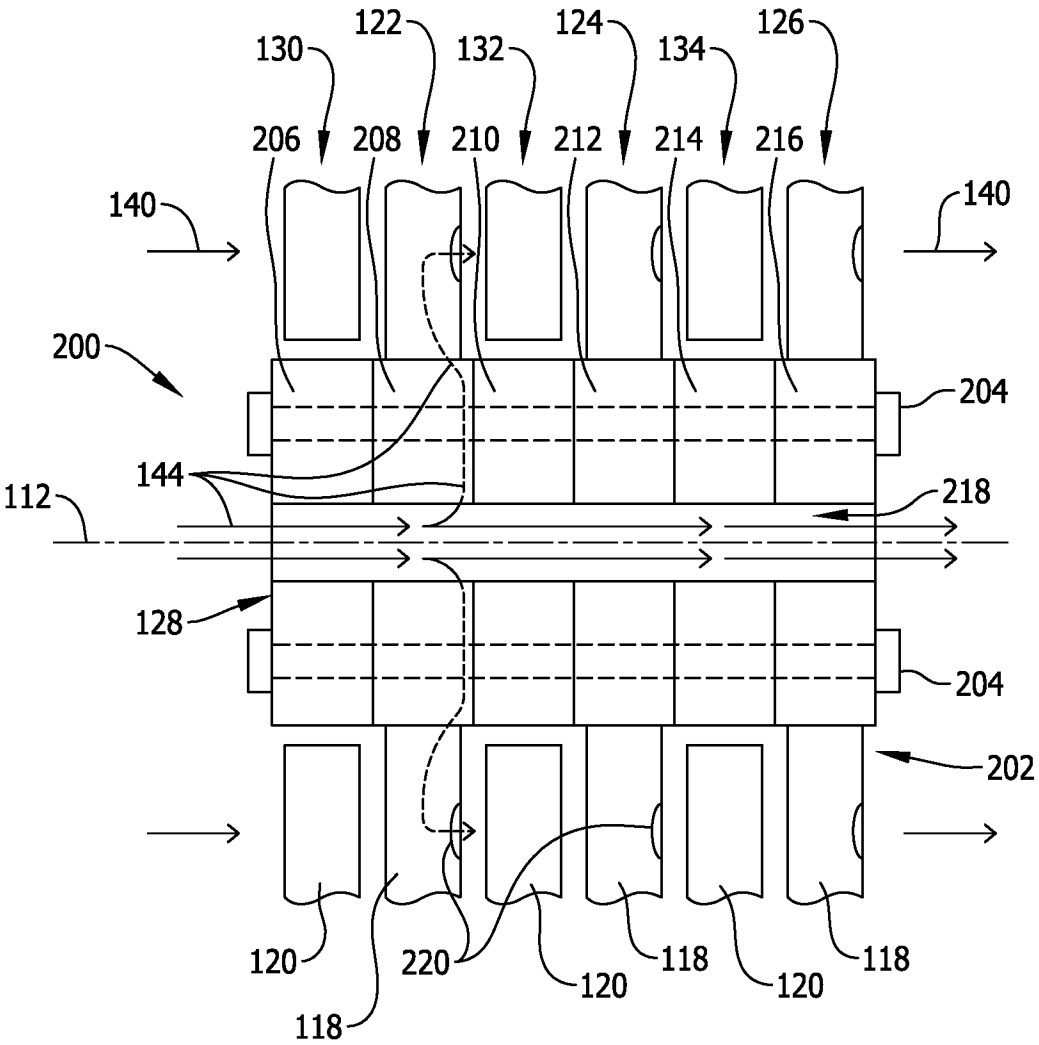
FIG. 2 is a schematic illustration of a turbine segment of an exemplary rotor shaft for use in the gas turbine assembly shown in FIG. 1.

FIG. 2 is a schematic illustration of an exemplary turbine segment 200 for use in rotor shaft 128. In the exemplary embodiment, turbine segment 200 includes a plurality of turbine discs 202 that are coupled together along axis 112 by a plurality of bolts 204, namely a first spacer disc 206, a first rotor disc 208, a second spacer disc 210, a second rotor disc 212, a third spacer disc 214, and a third rotor disc 216 arranged face-to-face in axially sequential order. As used herein, the term "turbine disc" refers to a disc of a rotor shaft segment that is axially aligned with a turbine section (e.g., turbine 106) not a compressor section (e.g., not compressor 102).

In the exemplary embodiment, first spacer disc 206 is axially aligned with and radially spaced apart from stator vanes 120 of first stator stage 130 such that first spacer disc 206 rotates relative to stator vanes 120 of first stator stage 130. First rotor disc 208 is axially aligned with and radially coupled to rotor blades 118 of first rotor stage 122 such that first rotor disc 208 rotates together with rotor blades 118 of first rotor stage 122. Second spacer disc 210 is axially aligned with and radially spaced apart from stator vanes 120 of second stator stage 132 such that second spacer disc 210 rotates relative to stator vanes 120 of second stator stage 132. Second rotor disc 212 is axially aligned with and radially coupled to rotor blades 118 of second rotor stage 124 such that second rotor disc 212 rotates together with rotor blades 118 of second rotor stage 124. Third spacer disc 214 is axially aligned with and radially spaced apart from stator vanes 120 of third stator stage 134 such that third spacer disc 214 rotates relative to stator vanes 120 of third stator stage 134. Third rotor disc 216 is axially aligned with and radially coupled to rotor blades 118 of third rotor stage 126 such that third rotor disc 216 rotates together with rotor blades 118 of third rotor stage 126. In other embodiments, turbine segment 200 of rotor shaft 128 may have any suitable quantity of spacer discs and/or rotor discs arranged in any suitable manner that facilitates enabling turbine rotor blades 118 to be cooled in the manner described herein.

As set forth above, cooling gas flow 144 is channeled into rotor blades 118 via rotor shaft 128 and subsequently injected into combustion gas flow 140 in turbine 106. More specifically, in the exemplary embodiment, cooling gas flow 144 is channeled axially along a central conduit 218 of rotor shaft 128 before being channeled radially outward between adjacent discs 202 of turbine segment 200 and into rotor blades 118 for injection into combustion gas flow 140 via cooling holes 220 formed in rotor blades 118. Because of the increased pressure requirement for combustion gas flow 140 through turbine 106 in some operating cycles of gas turbine assembly 100, it is desirable to ensure that the pressure of cooling gas flow 144 is at least the same as the pressure of combustion gas flow 140 in turbine 106 to facilitate ensuring that cooling gas flow 144 can be injected into combustion gas flow 140. Thus, because cooling gas flow 144 tends to experience a pressure drop in transit from compressor 102 to rotor blades 118 along rotor shaft 128 (e.g., along central conduit 218), it is desirable to increase the pressure of cooling gas flow 144 in order to facilitate channeling cooling gas flow 144 into rotor blades 118.

Figure 3:
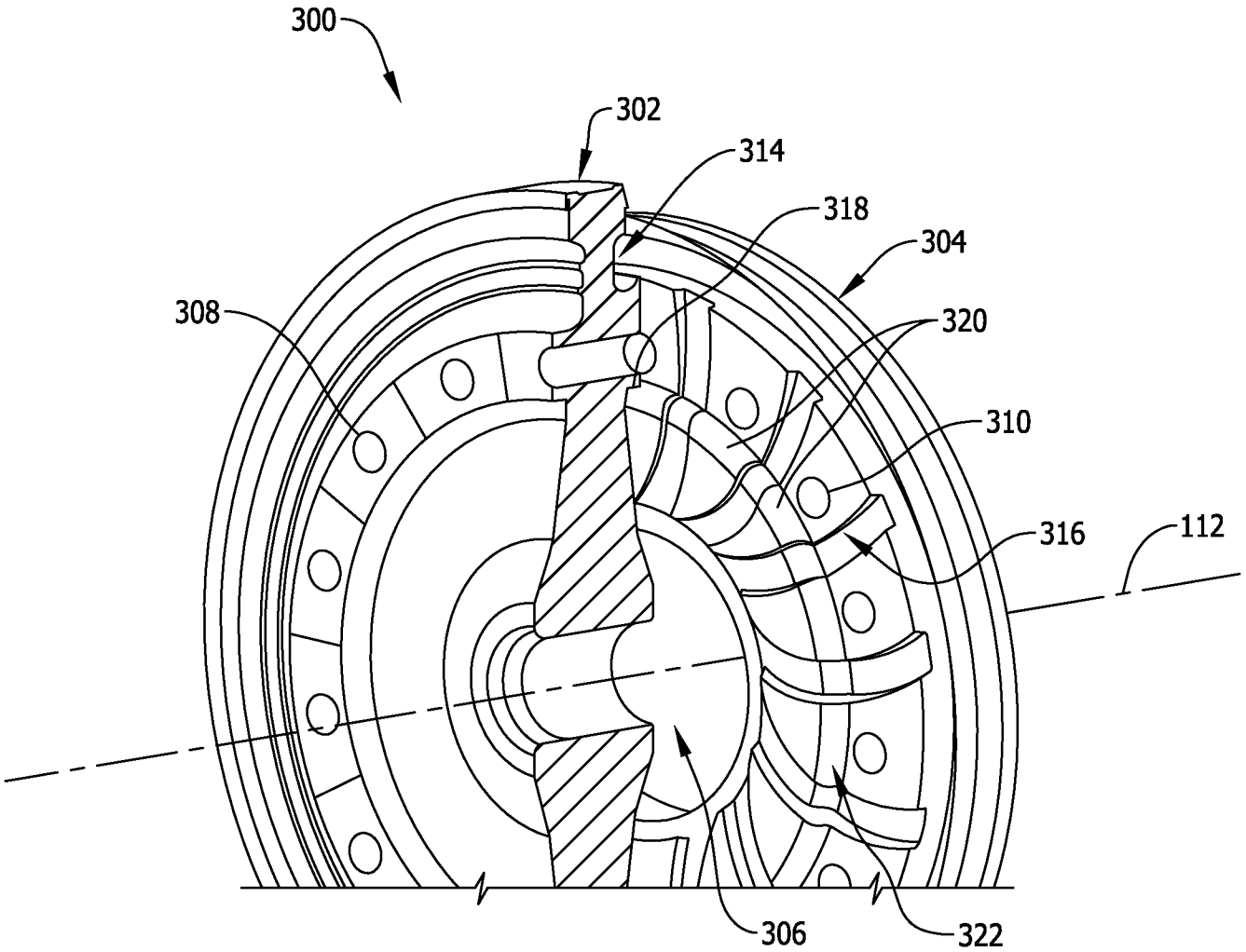
FIG. 3 is a partially cross-sectional perspective view of an exemplary turbine disc assembly for use in the turbine segment of the rotor shaft shown in FIG. 2.
Figure 4:
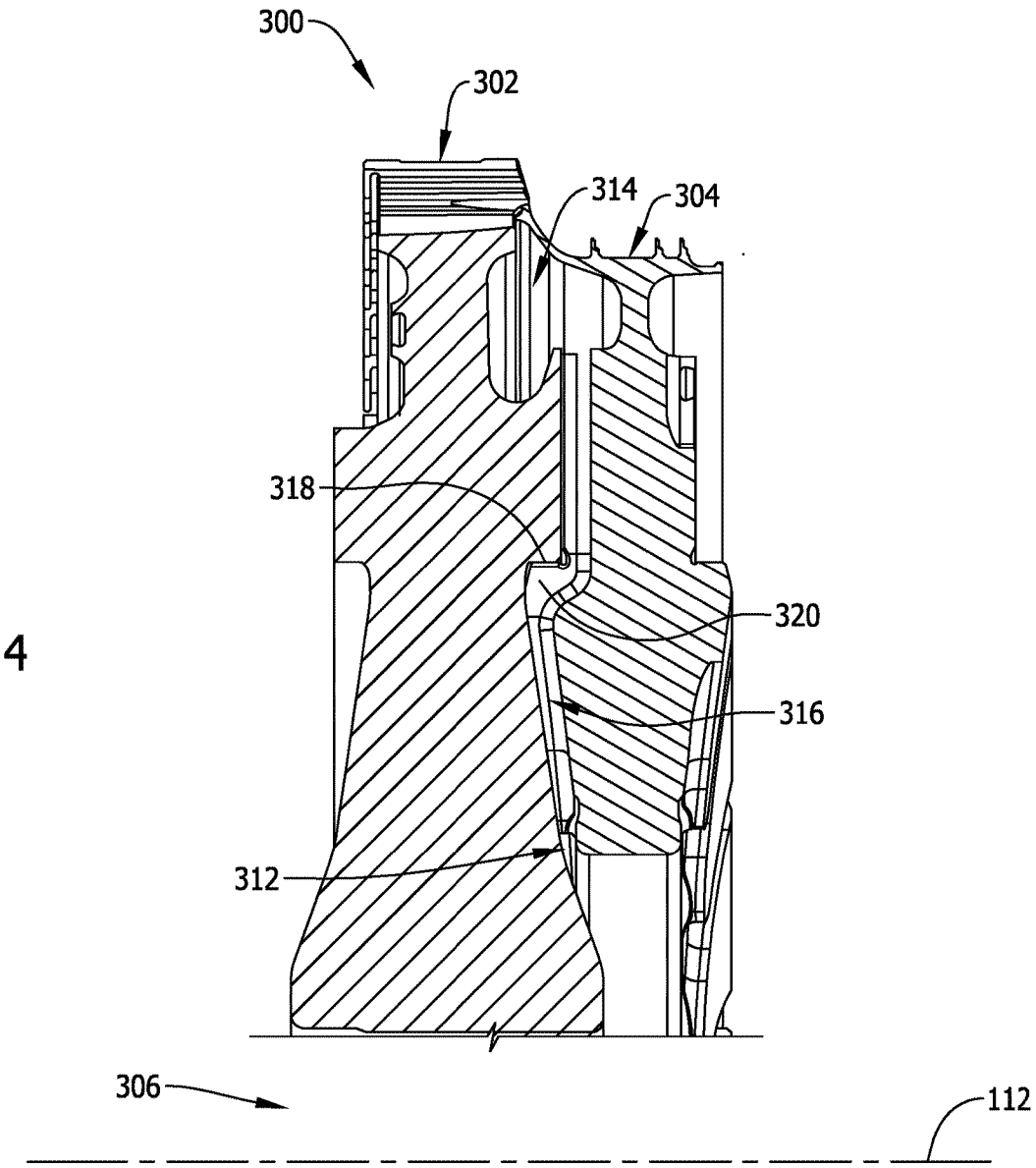
FIG. 4 is a partial cross-sectional view of the turbine disc assembly shown in FIG. 3.

FIG. 3 is a partially cross-sectional perspective view of an exemplary turbine disc assembly 300 for use in turbine segment 200, and FIG. 4 is a partial cross-sectional view of turbine disc assembly 300. In the exemplary embodiment, turbine disc assembly 300 includes a rotor disc 302 and an adjacent spacer disc 304 which are axially coupled together in face-to-face contact to define a segment 306 of central conduit 218. More specifically, rotor disc 302 has a plurality of bolt holes 308 which align with a plurality of corresponding bolt holes 310 of spacer disc 304 to receive bolts 204, thereby coupling rotor disc 302 and spacer disc 304 together for conjoint rotation about axis 112 during operation of gas turbine assembly 100. In other embodiments, turbine disc assembly 300 may have any suitable quantity of discs which interface together in any suitable manner that facilitates enabling turbine disc assembly 300 to function as described herein.

In the exemplary embodiment, rotor disc 302 and spacer disc 304 together define a radially inner plenum 312 and a radially outer plenum 314, both of which extend circumferentially about central conduit segment 306. A plurality of cooling channels 316 are formed in spacer disc 304, and cooling channels 316 extend from radially inner plenum 312 to radially outer plenum 314 such that radially inner plenum 312 and radially outer plenum 314 are in flow communication with one another across cooling channels 316. In other embodiments, rotor disc 302 and spacer disc 304 may define any suitable quantity of plenums (e.g., rotor disc 302 and spacer disc 304 may define radially outer plenum 314 but not radially inner plenum 312, and vice versa; or, rotor disc 302 and spacer disc 304 may not define any plenums).

In the exemplary embodiment, rotor disc 302 has a circumferential ledge 318 which is seated on spaced-apart segments 320 of a circumferential shoulder 322 of spacer disc 304 to facilitate maintaining rotor disc 302 and spacer disc 304 substantially concentric about axis 112 during operation of gas turbine assembly 100, as set forth in more detail below. Alternatively, rotor disc 302 and spacer disc 304 may be radially engaged with one another in any suitable manner that facilitates enabling turbine disc assembly 300 to function as described herein.

Figure 5:
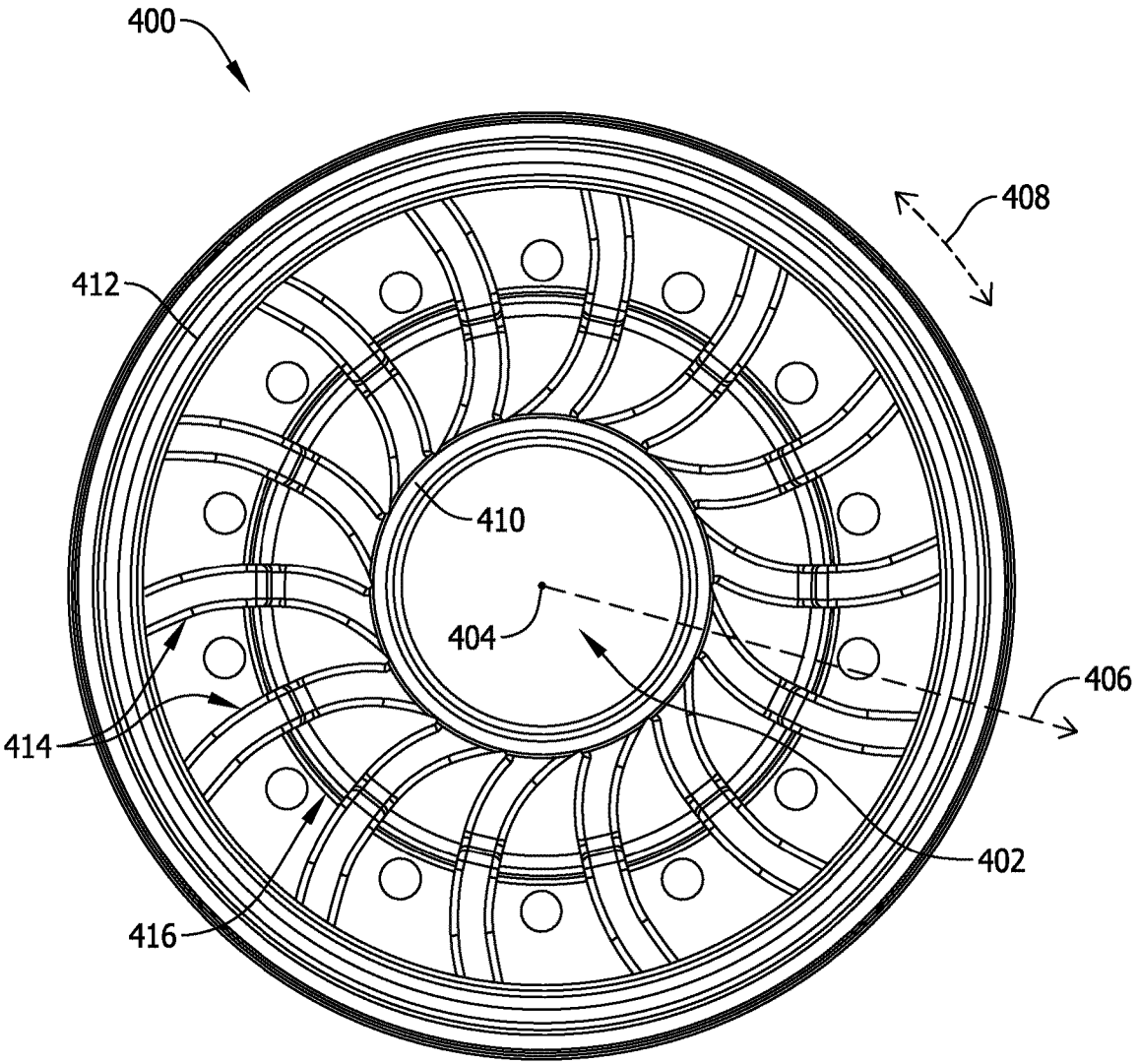
FIG. 5 is a side elevation view of an exemplary spacer disc for use in the turbine disc assembly shown in FIG. 3.
Figure 6:
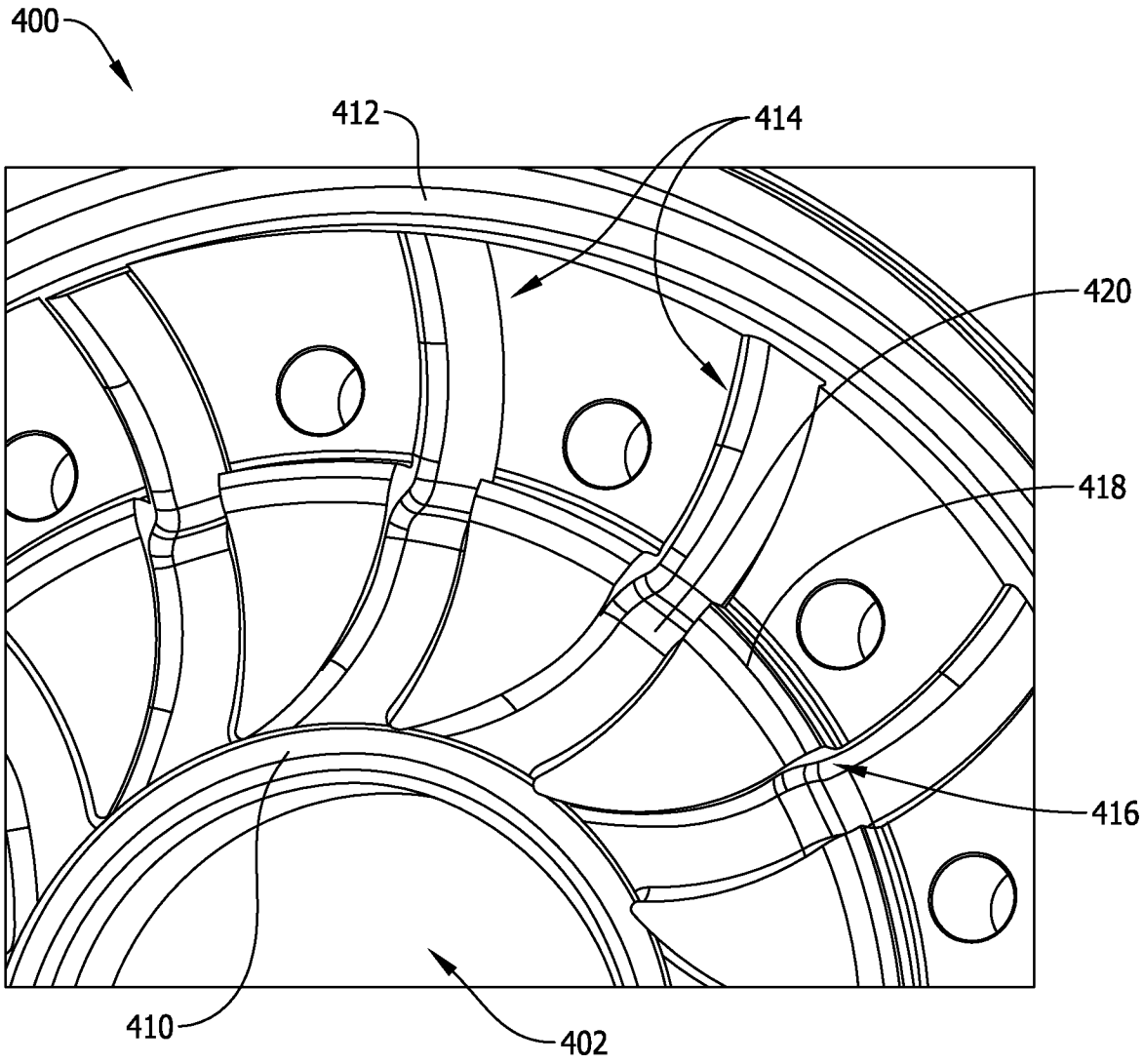
FIG. 6 is an enlarged perspective view of the spacer disc shown in FIG. 5.
Figure 7:
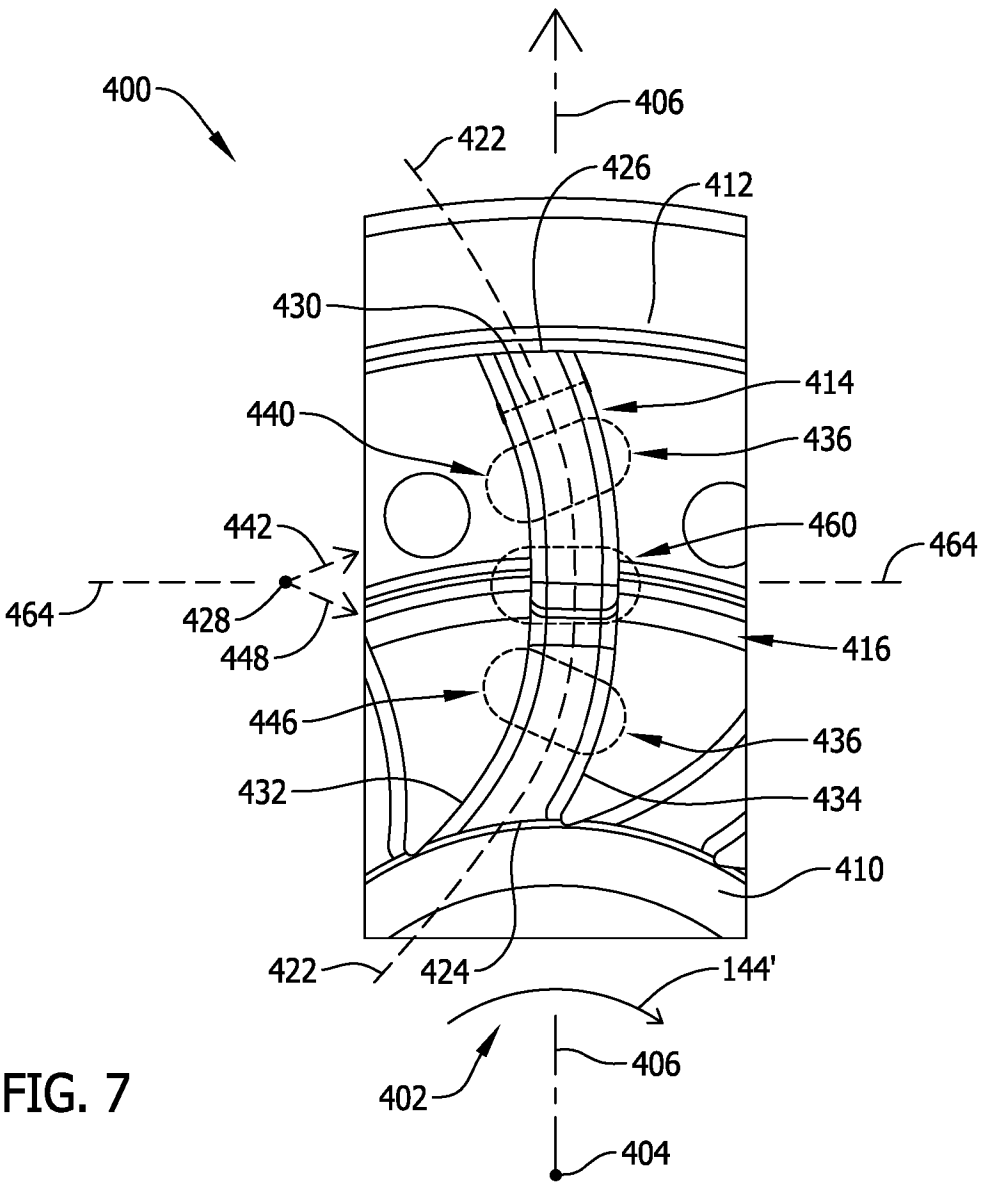
FIG. 7 is an enlarged portion of the side elevation view of the spacer disc shown in FIG. 5.

FIGS. 5-7 are various views of an exemplary spacer disc 400 for use in turbine disc assembly 300. In the exemplary embodiment, spacer disc 400 has a central aperture 402 with a center 404 through which axis 112 of gas turbine assembly 100 extends, such that central aperture 402 defines part of central conduit segment 306 and hence central conduit 218. The exemplary spacer disc 400 has a radial parameter 406 measured from center 404 and a circumferential parameter 408 measured around center 404. As used herein, the term "radius" (or any variation thereof) refers to a crosswise parameter of any suitable shape and is not limited to a crosswise parameter of a circular shape. Similarly, as used herein, the term "circumference" (or any variation thereof) refers to a perimetric parameter of any suitable shape and is not limited to a perimetric parameter of a circular shape.

In the exemplary embodiment, spacer disc 400 has a radially inner plenum segment 410, a radially outer plenum segment 412, and a plurality of cooling channels 414 extending from radially inner plenum segment 410 to radially outer plenum segment 412 across a circumferential shoulder 416. Thus, shoulder 416 extends through cooling channels 414 such that shoulder 416 has higher shoulder segments 418 (each defined between adjacent cooling channels 414) and lower shoulder segments 420 (each defined within a cooling channel 414). In other embodiments, shoulder 416 may not extend through cooling channels 414 (i.e., shoulder 416 may not have lower shoulder segments 420 but, instead, may include only spaced-apart higher shoulder segments 418).

In the exemplary embodiment, spacer disc 400 has fourteen cooling channels 414 that are circumferentially and substantially equally spaced apart from one another. In other embodiments, spacer disc 400 may have any suitable quantity of cooling channels 414. In the exemplary embodiment, each cooling channel 414 has a lengthwise axis 422 which is curved between a radially inner end 424 of cooling channel 414 and a radially outer end 426 of cooling channel 414 about a reference point 428 such that axis 422 is oriented substantially tangential to central aperture 402 at radially inner end 424 (i.e., such that axis 422 is not oriented radially toward center 404 at radially inner end 424). Each cooling channel 414 has a substantially uniform width 430 along axis 422 from radially inner end 424 to radially outer end 426 (as measured from an inner edge 432 of cooling channel 414 to an outer edge 434 of cooling channel 414). Thus, axis 422 is positioned substantially centrally between inner edge 432 and outer edge 434 from radially inner end 424 to radially outer end 426 (i.e., axis 422 is a centerline axis of cooling channel 414). In other embodiments, width 430 of each cooling channel 414 may vary along axis 422.

In the exemplary embodiment, at least one of inner edge 432, outer edge 434, and axis 422 has a plurality of comparatively different curvature segments 436, each of the various curvature segments 436 having a comparatively different change in radius (as measured from reference point 428) along its length (e.g., a first curvature segment 440 of inner edge 432 may have a first radius 442 from reference point 428 that changes along the length of first curvature segment 440, and a second curvature segment 446 of inner edge 432 may have a second radius 448 from reference point 428 that changes along the length of second curvature segment 446 in a manner different than the change of first radius 442 along the length of first curvature segment 440). Additionally, at least one of inner edge 432, outer edge 434, and axis 422 also has a substantially straight segment 460 which extends across shoulder 416 in the exemplary embodiment. In some embodiments, at least one of inner edge 432, outer edge 434, and axis 422 may be substantially parabolic about reference point 428 from radially inner end 424 to radially outer end 426 (e.g., reference point 428 may be a focus such that cooling channel 414 has an axis of symmetry 464 in some embodiments). Alternatively, each cooling channel 414 may have any suitable curvature from radially inner end 424 to radially outer end 426 that facilitates enabling cooling channels 414 to function as described herein (e.g., at least one of inner edge 432, outer edge 434, and axis 422 may have three such curvature segments, or four such curvature segments, with comparatively different radius changes along their respective lengths as measured from reference point 128).

During operation of gas turbine assembly 100, cooling gas flow 144 is channeled from compressor 102 through rotor shaft 128 and into rotor blades 118 of turbine 106 via radially inner plenum 312, cooling channels 316, and radially outer plenum 314 before being injected into combustion gas flow 140 in turbine 106. By virtue of being curved in the manner set forth above, cooling channels 316 facilitate increasing the pressure of cooling gas flow 144 for injection into combustion gas flow 140. More specifically, the curvature of cooling channels 316 and the substantially tangential orientation of axes 422 relative to central aperture 402 facilitate capturing the angular momentum of angular cooling gas flow 144' (shown in FIG. 7) from central aperture 402 into cooling channels 316, while also minimizing vortices within cooling channels 316. Cooling channels 316 thereby facilitate increasing the pressure of cooling gas flow 144 in part by minimizing pressure losses attributable to turbulence within cooling channels 316. Moreover, the substantially tangential orientation of axes 422 relative to radially outer plenum 314 at radially outer ends 426 of cooling channels 316 facilitates a reduction in relative tangential motion of cooling gas flow 144 as it enters rotor blades 118, thereby facilitating a further reduction in pressure losses. Additionally, while the pressure of cooling gas flow 144 is dynamic across cooling channels 316, this dynamic pressure is mostly converted into static pressure within radially outer plenum 314 to facilitate providing a smoother and more controlled cooling gas flow 144 into rotor blades 118.

In general, the formation of cooling channels in a component can reduce the local thickness of the component and, hence, reduce the structural integrity of the component. It is therefore desirable to form cooling channels only in components that experience less stress, particularly stress associated with centrifugal loading of the component. Hence, in the exemplary embodiment, cooling channels 316 are formed in spacer discs 304 (not in rotor discs 302) because rotor discs 302 are significant centrifugal load bearing components of rotor shaft 128 (e.g., rotor discs 302 bear the centrifugal loads associated with the rotation of rotor blades 118 and their own mass), whereas spacer discs 304 carry lower centrifugal loads (e.g., spacer discs 304 carry only the centrifugal loads associated with their own mass).

By virtue of being downstream of combustor 104, rotor discs 302 and spacer discs 304 experience significant thermal gradients which cause rotor discs 302 to periodically expand and contract relative to spacer discs 304, and vice versa. In the exemplary embodiment, the axially overlapping interface between ledge 318 of each rotor disc 302 and shoulder 322 of each adjacent spacer disc 304 facilitates maintaining substantial concentricity between discs 302 and 304 during such relative expansion and contraction. However, because ledge 318 contacts only higher shoulder segments 418 of spacer disc 304, higher shoulder segments 418 tend to bear substantially the entire radial load associated with the relative thermal expansion and contraction. As a result, the exemplary inner edge 432 and/or outer edge 434 of each cooling channel 316 has substantially straight segment 460 which facilitates increasing the structural integrity of spacer disc 304 at higher shoulder segments 418, thereby reducing the susceptibility of spacer disc 304 to failure under the radial loads concentrated at higher shoulder segments 418.

Additionally, because shoulder 322 is present in cooling channels 316 (i.e., at lower shoulder segments 420), the thermal mass of spacer discs 304 is increased as compared to if shoulder 322 was not present in cooling channels 316. By increasing the mass of spacer discs 304, the thermal response of spacer discs 304 is better matched to that of rotor discs 302, which are more massive as a result of their load bearing functionality. By better matching the relative thermal response (i.e., the relative rate of thermal expansion and contraction) between rotor discs 302 and spacer discs 304, at least some radial load concentrations at higher shoulder segments 418 are facilitated to be alleviated.

The methods and systems described herein facilitate cooling turbine rotor blades of a gas turbine assembly. More specifically, the methods and systems facilitate minimizing pressure losses in cooling gas flow channeled from the compressor into the turbine rotor blades of a gas turbine assembly. For example, the methods and systems facilitate minimizing pressure losses (e.g., flow separation) when cooling gas flow enters cooling channels between turbine discs of the rotor shaft, which in turn facilitates increasing the pressure of the cooling gas flow exiting the cooling channels into the turbine rotor blades. The methods and systems therefore facilitate injecting a cooling gas flow from turbine rotor blades into a combustion gas flow at a pressure which is at least the same as that of the combustion gas flow. As a result, the methods and systems facilitate ensuring that turbine rotor blades are properly cooled during operation of a gas turbine assembly, thereby improving the useful life of the turbine rotor blades.

Exemplary embodiments of turbine discs and methods of fabricating the same are described above in detail. The methods and systems described herein are not limited to the specific embodiments described herein, but rather, components of the methods and systems may be utilized independently and separately from other components described herein. For example, the methods and systems described herein may have other applications not limited to practice with gas turbine assemblies, as described herein. Rather, the methods and systems described herein can be implemented and utilized in connection with various other industries.

While the invention has been described in terms of various specific embodiments, those skilled in the art will recognize that the invention can be practiced with modification within the spirit and scope of the claims.

What is claimed is:

1. A turbine disc having a radius and a circumference, said turbine disc comprising:

a central aperture;

a plurality of cooling channels circumferentially spaced about said central aperture such that said cooling channels are in flow communication with said central aperture, wherein each of said cooling channels has a radially inner end, a radially outer end, and a lengthwise axis that is curved between said radially inner end and said radially outer end; and a shoulder extending circumferentially around said central aperture and through said plurality of cooling channels, said shoulder comprises a plurality of first shoulder segments adjacent to said plurality of cooling channels and a plurality of second shoulder segments within said plurality of cooling channels, wherein said plurality of first shoulder segments and said plurality of second shoulder segments each extend from said turbine disc, and wherein said plurality of first shoulder segments are axially displaced from said plurality of second shoulder segments.

2. A turbine disc in accordance with claim 1, wherein said lengthwise axis is oriented substantially tangential to said central aperture at said radially inner end.

3. A turbine disc in accordance with claim 1, further comprising a plenum segment extending circumferentially about said central aperture.

4. A turbine disc in accordance with claim 1, wherein said turbine disc is a spacer disc.

5. A turbine disc in accordance with claim 1, wherein each of said cooling channels has an edge including a substantially straight segment extending across said shoulder.

6. A turbine disc in accordance with claim 1, wherein each of said cooling channels has a substantially uniform width along said lengthwise axis from said radially inner end to said radially outer end.

7. A method of fabricating a turbine disc having a radius and a circumference, said method comprising:

forming a central aperture in a turbine disc;

forming a plurality of cooling channels in the turbine disc such that the cooling channels are circumferentially spaced about the central aperture in flow communication with the central aperture, wherein each of the cooling channels has a radially inner end, a radially outer end, and a lengthwise axis that is curved between the radially inner end and the radially outer end; and forming a shoulder in the turbine disc such that the shoulder extends circumferentially around the central aperture and through the plurality of cooling channels, the shoulder comprises a plurality of first shoulder segments adjacent to the plurality of cooling channels and a plurality of second shoulder segments within the plurality of cooling channels, wherein the plurality of first shoulder segments and the plurality of second shoulder segments each extend from the turbine disc, and wherein the plurality of first shoulder segments are axially displaced from the plurality of second shoulder segments.

8. A method in accordance with claim 7, further comprising forming each of the cooling channels such that the lengthwise axis is oriented substantially tangential to the central aperture at the radially inner end.

9. A method in accordance with claim 7, further comprising forming a plenum segment in the turbine disc such that the plenum segment extends circumferentially about the central aperture.

10. A method in accordance with claim 7, further comprising forming the turbine disc as a spacer disc.

11. A method in accordance with claim 7, further comprising forming each of the cooling channels with an edge having a substantially straight segment extending across the shoulder.

12. A method in accordance with claim 7, further comprising forming each of the cooling channels with a substantially uniform width along the lengthwise axis from the radially inner end to the radially outer end.

13. A gas turbine assembly comprising:

a rotor disc; and a spacer disc coupled to said rotor disc, wherein said spacer disc has a radius and a circumference, said spacer disc comprising:

a central aperture;

a plurality of cooling channels circumferentially spaced about said central aperture such that said cooling channels are in flow communication with said central aperture, wherein each of said cooling channels has a radially inner end, a radially outer end, and a lengthwise axis that is curved between said radially inner end and said radially outer end; and a shoulder extending circumferentially around said central aperture and through said plurality of cooling channels, said shoulder comprises a plurality of first shoulder segments adjacent to said plurality of cooling channels and a plurality of second shoulder segments within said plurality of cooling channels, wherein said plurality of first shoulder segments and said plurality of second shoulder segments each extend from said turbine disc, and wherein said plurality of first shoulder segments are axially displaced from said plurality of second shoulder segments.

14. A gas turbine assembly in accordance with claim 13, wherein said lengthwise axis is oriented substantially tangential to said central aperture at said radially inner end.

15. A gas turbine assembly in accordance with claim 13, wherein said spacer disc further comprises a plenum segment extending circumferentially about said central aperture.

16. A gas turbine assembly in accordance with claim 13, wherein each of said cooling channels has an edge including a substantially straight segment extending across said shoulder.

17. A gas turbine assembly in accordance with claim 13, wherein each of said cooling channels has a substantially uniform width along said lengthwise axis from said radially inner end to said radially outer end.

* * * * *